US007995935B2

(12) United States Patent
Okada

(10) Patent No.: US 7,995,935 B2
(45) Date of Patent: Aug. 9, 2011

(54) DEVELOPER DEVICE, IMAGE FORMING APPARATUS, AND TONER REPLENISHMENT METHOD

(75) Inventor: Masanori Okada, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/621,566

(22) Filed: Nov. 19, 2009

(65) Prior Publication Data

US 2010/0129092 A1 May 27, 2010

(30) Foreign Application Priority Data

Nov. 25, 2008 (JP) ..... 2008-299038

(51) Int. Cl.
*G03G 15/08* (2006.01)

(52) U.S. Cl. ..... 399/30; 399/58

(58) Field of Classification Search ..... 399/30, 399/58, 61, 62, 63, 64
See application file for complete search history.

(56) References Cited

U.S. PATENT DOCUMENTS 5,311,261 A 5/1994 Nakagama et al.
5,649,266 A * 7/1997 Rushing ..... 399/59
7,177,557 B2 * 2/2007 Kreckel ..... 399/30
7,603,046 B2 * 10/2009 Hirayama ..... 399/30
2009/0080913 A1 * 3/2009 Suzuki ..... 399/30

FOREIGN PATENT DOCUMENTS

JP 5-107924 4/1993
JP 7-271174 10/1995
JP 2008-276118 A * 11/2008

* cited by examiner

*Primary Examiner* — Sophia S Chen

(74) *Attorney, Agent, or Firm* — Gerald E. Hespos; Michael J. Porco

(57) ABSTRACT

A differential sensitivity calculation portion calculates the differential sensitivity D of a toner concentration sensor, using an output voltage V1 and V2 of the toner concentration sensor when a toner chamber is in a state of toner concentration T1 and T2 at the time of initial operation of a printer, or at some other time. A toner replenishment control portion takes as input a current output voltage Vs output from the toner concentration sensor, calculates the toner concentration in the toner chamber using the output voltage Vs and the differential sensitivity D calculated by the differential sensitivity calculation portion, and outputs a control signal to a toner replenishment motor so as to maintain the toner concentration in the toner chamber at an appropriate concentration.

6 Claims, 4 Drawing Sheets

DEVELOPER DEVICE, IMAGE FORMING APPARATUS, AND TONER REPLENISHMENT METHOD

BACKGROUND OF THE INVENTION

1. Field of the Invention

This invention relates to a developer device in a printer, photocopier or similar, to an image forming apparatus, and to a toner replenishment method in a developer device, and in particular relates to a developer device which forms an image by using a two-component developer comprising a toner and a carrier to develop an electrostatic latent image formed on an image-carrying member, as well as an image forming apparatus and a toner replenishment method in a developer device.

2. Description of the Related Art

In electro photographic image forming apparatuses, an electrostatic latent image formed on a photosensitive drum using a two-component developer comprising a toner and a carrier is visualized as a toner image, and this toner image is transferred onto recording paper to form an image.

A developer device used in such a two-component development type image forming apparatus is configured, for example, so as to use an agitator to agitate toner supplied to a holding chamber from a cartridge which houses toner, while transporting the toner, and to supply toner which has mixed with the carrier through agitation and which has been friction-charged to a photosensitive drum. That is, toner supplied to the holding chamber is consumed by development of an electrostatic latent image. Hence the developer device comprises a toner concentration sensor which measures the toner concentration in the holding chamber (the ratio of toner to carrier); the toner concentration sensor measures the toner concentration, and supplies toner from the cartridge appropriately based on a voltage value such that the toner concentration in the holding chamber coincides with a target value, to control the toner concentration.

SUMMARY OF THE INVENTION

This invention is a further improvement on the above-described technology of the prior art.

This invention relates to a developer device, comprising: a developer portion which, while agitating, supplies a two-component developer of toner and carrier in a holding chamber to a photosensitive drum to develop an electrostatic latent image formed on the photosensitive drum, and form a toner image; a cartridge which houses toner; a measurement portion which measures the toner concentration in the holding chamber, converts a measurement result into a voltage value and outputs the voltage value; a replenishment portion which replenishes the holding chamber with toner from the cartridge; a calculation portion which uses a first voltage value measured by the measurement portion when the toner concentration of the holding chamber is a predetermined first toner concentration, and a second voltage value measured by the measurement portion when the toner concentration of the holding chamber is a predetermined second toner concentration, to calculate a differential sensitivity of the measurement portion; and a replenishment control portion which calculates the toner concentration in the holding chamber using the voltage value output from the measurement portion and the calculated differential sensitivity, and which controls replenishment of the holding chamber with toner by the replenishment portion according to the calculated toner concentration.

DETAILED DESCRIPTION OF THE PREFERRED EMBODIMENTS

Figure 1:
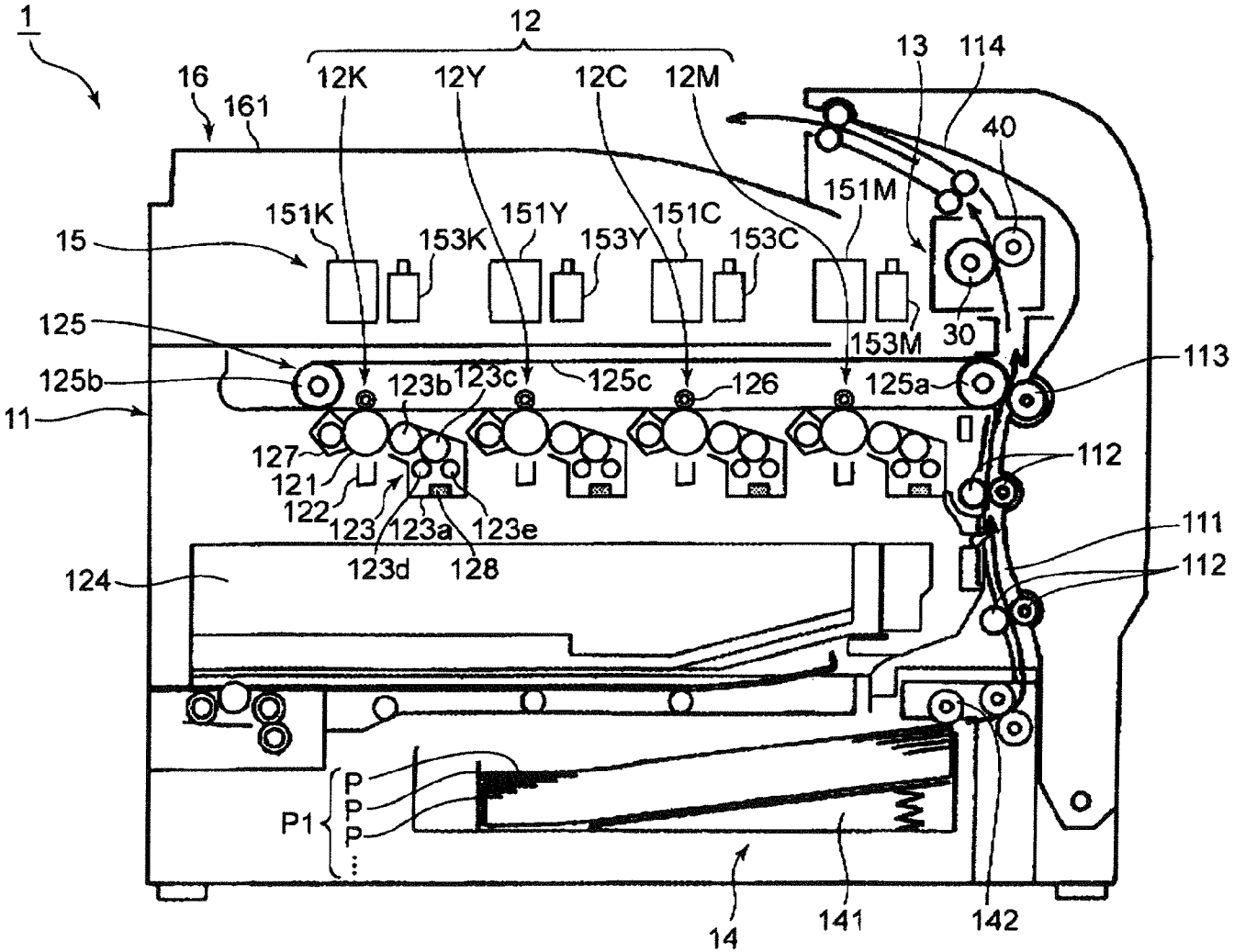
FIG. 1 is a summary cross-sectional view of a printer.

Below, the image forming apparatus of one embodiment of the invention is explained, referring to the drawings. In this embodiment, a printer is explained as an example of an image forming apparatus; but in addition, the device may be a photocopier, or a multifunctional device which performs the functions of a photocopier, scanner, fax machine, printer, and similar. Also, in this embodiment an example of a tandem-type printer is explained; but an electrophotography printer using a two-component developer comprising a toner and a carrier may be used.

FIG. 1 is a summary cross-sectional view of the printer 1 of this embodiment. As shown in FIG. 1, the printer 1 comprises a box-shaped main unit 11. The main unit 11 internally comprises an image formation portion 12, which forms images based on image data transmitted from a computer or other outside equipment; a fixing portion 13, which performs fixing treatment of a toner image formed by this image formation portion 12 and transferred onto recording paper P as transfer material; a paper retention portion 14, which retains recording paper for transfer; and a toner replenishment portion 15, which replenishes the image formation portion 12 with toner. In addition, a paper ejection portion 16, to which recording paper P is ejected after fixing treatment, is provided on the upper portion of the main unit 11.

At an appropriate place on the upper face of the main unit 11 are provided operation keys (not shown) for performing operations to input the output conditions for the recording paper P and other parameters, and a display panel (not shown) on which messages for the user and similar are displayed. In the operation keys are provided a power key, setting keys used to set various parameters, and similar.

The paper retention portion 14 comprises a paper tray 141, removably installed in a position within the main unit 11 below the exposure device 124. The paper tray 141 comprises a box body the upper face of which is entirely open, and can retain a recording paper sheaf P1 in which are stacked a plurality of pages of recording paper P. The uppermost recording paper P of the recording paper sheaf P1 retained in the paper tray 141 is fed out from the recording paper sheaf P1 toward the paper transport path 111 through driving of the downstream end (the right end in FIG. 1) of the upper face by the pickup roller 142. The recording paper P, fed out one page at a time, is driven by the transport roller 112, and passing through the paper transport path 111, is sent to the nip portion between the second transfer roller 113 and the driving roller 125*a*, (intermediate transfer belt 125*c*) in the image formation portion 12.

The image formation portion 12 forms a toner image on recording paper P supplied from the paper retention portion 14; in this embodiment, a black developer unit 12K using black toner, a yellow developer unit 12Y using yellow toner, a cyan developer unit 12C using cyan toner, and a magenta developer unit 12M using magenta toner, arranged in order from the upstream side (the left side in FIG. 1) toward the downstream side, are comprised.

And, the developer units 12K, 12Y, 12C, and 12M each comprise a photosensitive drum 121; charging device 122, which uniformly charges the peripheral face of the photosensitive drum 121; exposure device 124, which irradiates the charged peripheral face of the photosensitive drum 121 with laser light based on image data, and forms an electrostatic latent image on the peripheral face of the photosensitive drum 121; developer device 123, which develops the electrostatic latent image formed on the peripheral face of the photosensitive drum 121 and forms a toner image; transfer roller 126, which transfers the toner image formed on the peripheral face of the photosensitive drum 121 to an intermediate transfer belt 125*c*; and cleaning device 127, which removes toner remaining on the peripheral face of the photosensitive drum 121 after the toner image has been transferred.

The developer devices (developer portions) 123 each have a toner receptacle (holding chamber) 123*a*, which receives toner; developer roller 123*b*; magnetic roller 123*c*; paddle mixer 123*d*; agitating mixer 123*e*; and toner concentration sensor (measurement portion) 128. The developer roller 123*b*, by rotating while carrying toner on the surface, visualizes (develops) the electrostatic latent image formed in advance on the peripheral face of the photosensitive drum 121 as a toner image. The magnetic roller 123*c*, causes the two-component developer to be adsorbed due to a magnetic arranged therewithin, generating a magnetic brush, to supply toner to the developer roll 123*b*. The paddle mixer 123*d*, and agitating mixer 123*e*, have helical blades and perform agitation while transporting the two-component developer in opposite directions, to cause the toner to be charged. Further, the paddle mixer 123*d*, supplies the two-component developer, comprising charged toner and carrier, to the magnetic roller 123*c*.

In the vicinity of the bottom edge of the toner receptacle 123*a*, is arranged a toner concentration sensor 128, which detects the toner concentration within the toner receptacle 123*a*. The toner concentration sensor 128 detects the magnetic permeability of the toner in the toner receptacle 123*a*, at fixed time intervals, converts the detected permeability into a voltage value, and outputs the voltage value to a control portion, described below. The control portion calculates the toner concentration in the toner receptacle 123*a*, based on the voltage value output from the toner concentration sensor 128, and outputs a control signal to a toner replenishment motor (replenishment portion) 153, described below, so as to maintain the toner concentration at an appropriate concentration, and so adjusts the amount of toner with which the toner receptacle 123*a*, is replenished.

An intermediate transfer member 125 is provided at a position above the photosensitive drum 121. This intermediate transfer member 125 has an endless intermediate transfer belt 125*c*, tautly provided between the driving roller 125*a*, and the slave roller 125*b*, so as to abut the peripheral faces of each of the photosensitive drums 121 below the intermediate transfer belt 125*c*. This intermediate transfer belt 125*c*, in a state of being pressed against the peripheral face of the photosensitive drums 121 by the transfer rollers 126 provided corresponding to each photosensitive drum 121, revolves between the driving roller 125*a*, and the slave roller 125*b*, in synchronization with each of the photosensitive drums 121.

Hence through revolution of the intermediate transfer belt 125*c*, transfer of the black toner image by the photosensitive drum 121 of the developer unit 12K onto the surface thereof is performed; next, transfer of the yellow toner image by the photosensitive drum 12Y onto the same position of the intermediate transfer belt 125*c*, is performed in a state of overlapping application; next, transfer of the cyan toner image by the photosensitive drum 121 of the developer unit 12C onto the same position of the intermediate transfer belt 125*c*, is performed in a state of overlapping application; and finally, transfer of the magenta toner mediate by the photosensitive drum 121 of the developer unit 12M is performed. By this means, black toner, yellow toner, cyan toner, and magenta toner are applied to the surface of the intermediate transfer belt 125*c*, to form a color toner image.

A paper transport path 111 extending in the vertical direction is formed in a rightward position in FIG. 1 in the image formation portion 12. A pair of transport rollers 112 is provided at appropriate places on this paper transport path 111, and recording paper fed from the paper retention portion 14 is transported, through driving by the transport roller pair 112, toward the intermediate transfer belt 125*c*, driven in rotation by the driving roller 125*a*.

A second transfer roller 113, abutting the surface of the intermediate transfer belt 125*c*, at a position opposing the driving roller 125*a*, is provided on this paper transport path 111; recording paper P, while being transported on the paper transport path 111, is enclosed between and pressed by the transfer belt 125*c*, and second transfer roller 113, and by this means the toner image on the intermediate transfer belt 125*c*, is transferred onto the recording paper P.

The fixing portion 13 performs fixing treatment of the toner image transferred onto the recording paper P by the image formation portion 12, and internally comprises a heating roller 30 in which is mounted a halogen lamp or other conductive heating member, and a pressing roller 40, positioned in opposition to the peripheral face of this heating roller 30. With the toner image of the intermediate transfer belt 125*c*, transferred thereupon, the recording paper P supplied to the fixing portion 13 passes through the nip portion of the rotating heating roller 30 and pressing roller 40, and receiving heat from the heating roller 30, is subjected to fixing treatment. After completion of fixing treatment, the recording paper P passes through the ejection transport path 114 extending from above the fixing portion 13, and is ejected toward an ejection tray 161 of the paper ejection portion 16 provided at the top of the main unit 11.

The toner replenishment portion 15 comprises, corresponding to each developer unit of the image formation portion 12, a black cartridge 151K, yellow cartridge 151Y, cyan cartridge 151C, and magenta cartridge 151M (hereafter "cartridge 151"), and, corresponding to each cartridge 151, toner replenishment motors 153K, 153Y, 153C, and 153M (hereafter "toner replenishment motor 153"). Toner of each color is housed in the respective cartridges 151, which are removably mounted in the main unit 11. When the amount of toner in a cartridge 151 becomes scarce, the user replenishes the toner in the main unit 11 by replacing the cartridge with a new cartridge 151.

The toner replenishment motors 153 perform driving according to control signals output from the control portion, described below, and replenish the toner receptacles 123*a*, of the developer units 12 with toner from the cartridges 151, through driving by the toner replenishment motors 153.

Figure 2:
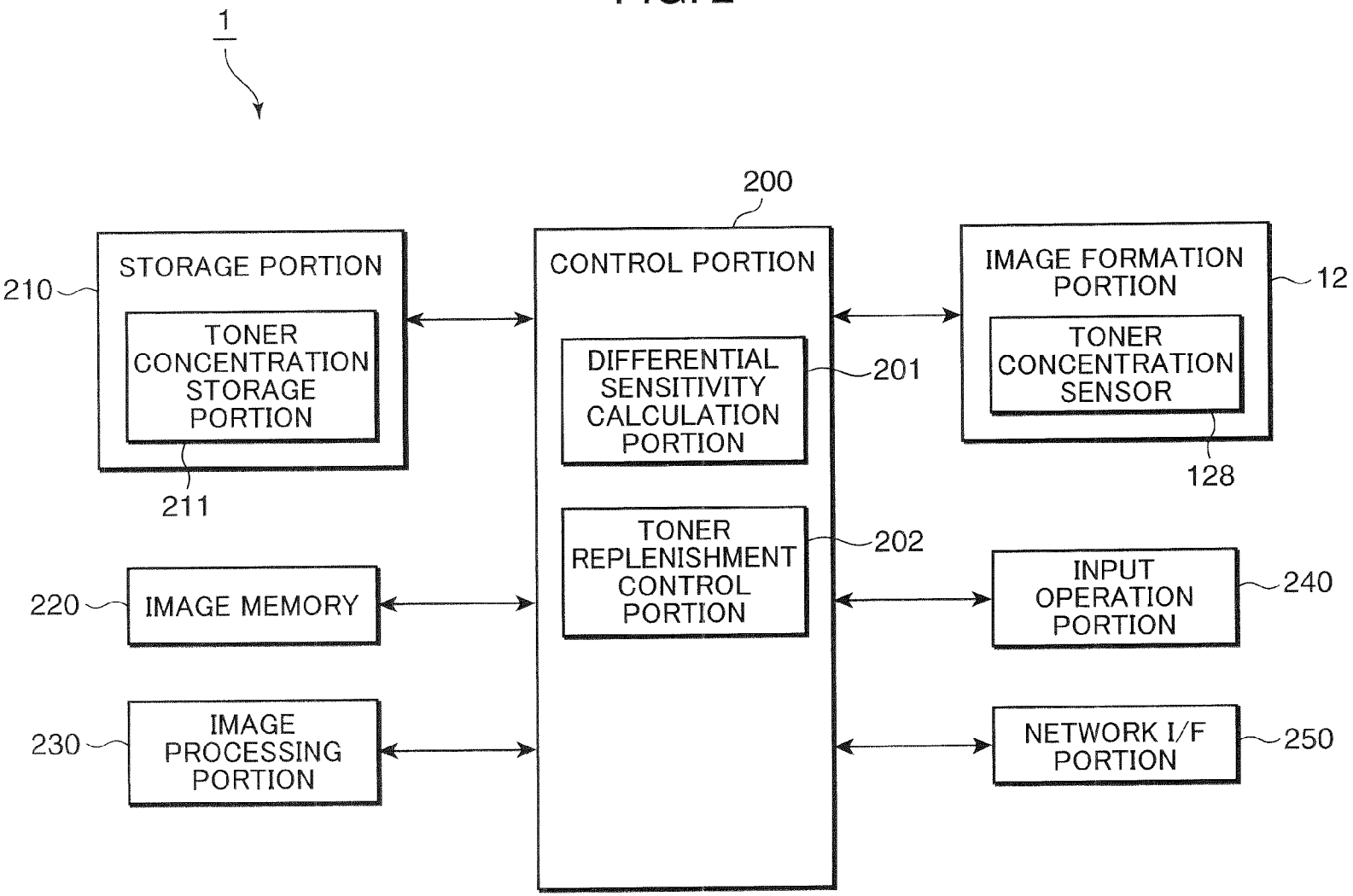
FIG. 2 is a block diagram showing the electrical configuration of a printer.

FIG. 2 is a block diagram showing the electrical configuration of the printer 1. The printer 1 comprises a control portion 200, storage portion 210, image memory 220, image processing portion 230, image formation portion 12, input operation portion 240, and network I/F portion 250. Portions which are the same as constituent elements explained using FIG. 1 are assigned the same symbols, and explanations are omitted.

The storage portion 210 stores programs, data and similar used to realize the various actions of the printer 1. In this embodiment, the storage portion 210 acts as a toner concentration storage portion (storage portion) 211. This toner concentration storage portion 211 is explained below.

The image memory 220 stores image data transmitted from an external device via the network I/F portion 250. The image processing portion 230 performs image correction, enlargement/reduction, and other image processing of image data stored in the image memory 220. The image formation portion 12 forms toner images based on image data output from the image memory 220. The input operation portion 240 has a power key and a setting key. The network I/F portion 250 comprises a LAN board or other communication module, and transmits and receives various data to and from an external device via a network (not shown) connected to the network I/F portion 250.

The control portion 200 comprises a CPU (Central Processing Unit) or similar, and reads and executes a program stored in the storage portion 210, outputs instruction signals to various portions, transfers data, and comprehensively controls the printer 1. The control portion 200 has a differential sensitivity calculation portion 201 and a toner replenishment control portion 202.

The differential sensitivity calculation portion (calculation portion) 201 calculates the differential sensitivity of the toner concentration sensor 128. The "differential sensitivity" is the amount of change in the output voltage of the toner concentration sensor 128 with a change in the toner concentration. If the first toner concentration is T1, the output voltage of the toner concentration sensor 128 at this time is V1, the second toner concentration is T2, and the output voltage of the toner concentration sensor 128 at this time is V2, then the differential sensitivity D can be calculated from $$D=(V1-V2)/(T1-T2) \quad (1)$$

Figure 3:
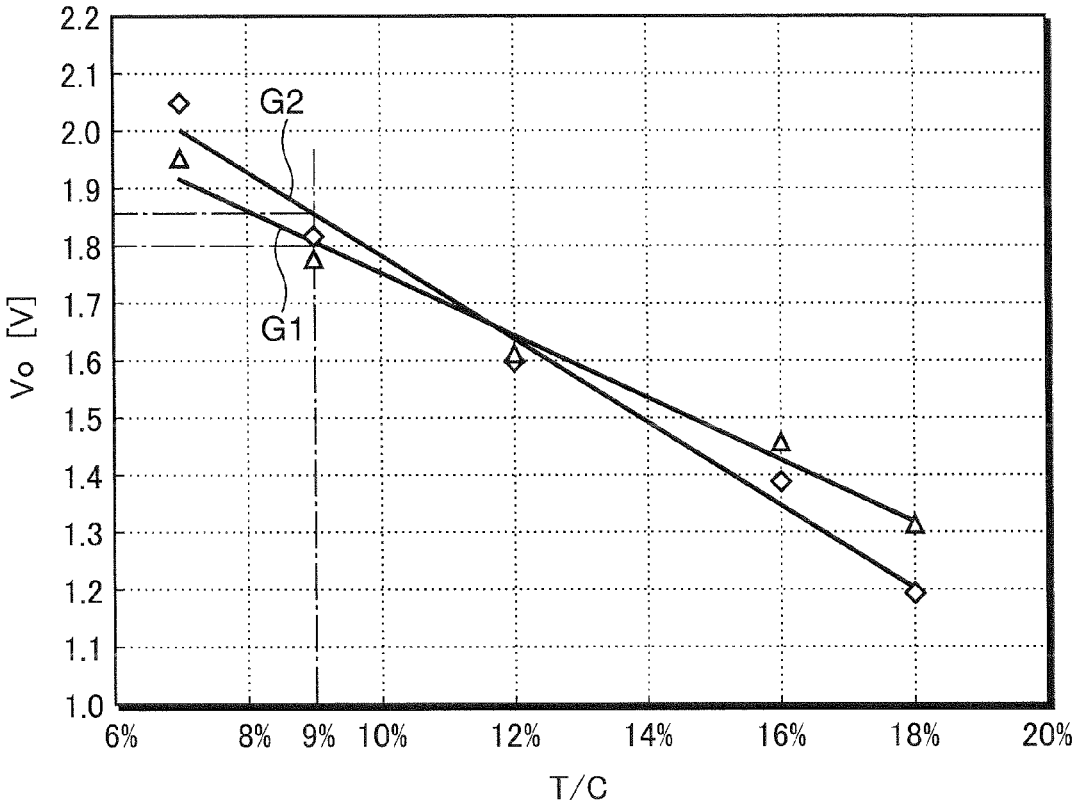
FIG. 3 is a graph showing the relation between output voltage and toner concentration for different toner concentration sensors.

This differential sensitivity D is known to be varied according to the characteristics of the toner concentration sensor 128. FIG. 3 is a graph showing the relation between toner concentration and output voltage for different toner concentration sensors G1 and G2. When the toner concentration is 9%, the output voltage of the toner concentration sensor G1 is 1.8 V, but the output voltage of the toner concentration sensor G2 is 1.86 V. Suppose for example that the toner concentration sensor G2 is installed in the toner receptacle 123*a*, and that the control portion performs toner replenishment control when the toner concentration in the toner receptacle 123*a*, is 9%. In this case, the output voltage of the toner concentration sensor G2 at a toner concentration of 9% is 1.86 V, and so the control portion is designed in advance so as to perform toner replenishment control when an output voltage of 1.86 V is output from the toner concentration sensor.

However, if the toner concentration sensor G1, with different differential sensitivity, is installed in the toner receptacle 123*a*, and toner replenishment control is performed by a control portion designed as described above, when the output voltage from the toner concentration sensor G1 is 1.86 V, the toner concentration in the toner receptacle 123*a*, has already fallen to 8%. When the timing of toner replenishment is thus shifted due to differences in the characteristics of toner concentration sensors 128, the toner concentration in the toner receptacle 123*a*, cannot be properly maintained, and degraded image quality results.

Hence in this embodiment, a method is proposed in which the differential sensitivity of the toner concentration sensor 128 is calculated at the time of initial operation of the printer 1 or at a similar time, and the calculated differential sensitivity is used for toner replenishment control during operation. Below, a specific explanation is given. First, the differential sensitivity calculation portion 201 uses the output voltages V1, V2 of the toner concentration sensor 128 in states in which the toner concentration in the toner receptacle 123*a*, is toner concentration T1 and toner concentration T2 (T1≠T2), to calculate the differential sensitivity D of the toner concentration sensor 128.

Here, the toner concentration T1 is the toner concentration when, at the time of initial operation of the printer 1 (immediately after shipment from the factory), a prescribed amount of toner is supplied to the toner receptacle 123*a*, in a state in which no toner at all is supplied to the toner receptacle 123*a*, (that is, toner concentration 0%). For example, when the toner concentration T1 is to be 9%, the amount of toner, in grams, which should be supplied while in the state of toner concentration 0% to result in a toner concentration of 9% can be calculated based on the carrier amount in the toner receptacle 123*a*, at this time. The amount of toner supplied can for example be determined from calculations using the number of rotations of the toner replenishment motor 153.

The toner concentration T2 is the toner concentration when a prescribed amount of toner is supplied to the toner receptacle 123*a*, in the state of toner concentration T1. For example, when the toner concentration T2 is to be 12%, the difference with the toner concentration T1 is 3%, and the amount of toner, in grams, which should be supplied to increase the toner concentration by 3% can be calculated. In this way, the differential sensitivity calculation portion 201 takes as inputs the output voltage V1 of the toner concentration sensor 128 when the toner receptacle 123*a*, is in the state of toner concentration T1, and takes as input the output voltage V2 of the toner concentration sensor 128 when the toner receptacle 123*a*, is in the state of toner concentration T2. And, the values are substituted into equation (1) to calculate the differential sensitivity D for the toner concentration sensor 128.

Thereafter, when toner concentration control of the toner receptacle 123*a*, is performed during operation of the printer 1, first the toner replenishment control portion (replenishment control portion) 202 inputs the current output voltage Vs from the toner concentration sensor 128. Then, using this output voltage Vs and the differential sensitivity D calculated by the differential sensitivity calculation portion 201, the toner concentration Ts in the toner receptacle 123*a*, is calculated. Specifically, upon modifying equation (1), the following is obtained.

$$D=(V1-V2)/(T1-T2)=(V1-Vs)/(T1-Ts)$$

$$T1-Ts=(V1-Vs)/D$$

$$Ts=T1-(V1-Vs)/D \quad (2)$$

By substituting into equation (2) the differential sensitivity D and the output voltage V1 of the toner concentration sensor 128 when the toner receptacle 123*a*, is in the state of toner concentration T1, as well as the current output voltage Vs of the toner concentration sensor 128, the current toner concentration Ts of the toner receptacle 123*a*, can be calculated. And, the toner replenishment control portion 202 outputs control signals to the toner replenishment motor 153 so as to maintain the toner concentration in the toner receptacle 123*a*, at an appropriate concentration. The toner replenishment motor 153 performs driving, according to these control signals, such that the toner receptacle 123*a*, is replenished with toner from the cartridge 151.

In order to calculate the current toner concentration Ts using equation (2), the output voltage V1 of the toner concentration sensor 128 when the toner receptacle 123*a*, is in the state of toner concentration T1, the differential sensitivity D calculated at the time of initial operation, and equation (2) are stored in memory (not shown) within the control portion 200 or similar. When an output voltage Vs is output from the toner concentration sensor 128, the toner replenishment control portion 202 reads equation (2) and various data from internal memory, and calculates the toner concentration Ts. Equation (2) is one example; the control portion 200 may generate an equation using the differential sensitivity D alone, and the toner replenishment control portion 202 may substitute the current output voltage Vs of the toner concentration sensor 128 into this equation to obtain the toner concentration Ts.

Figure 4:
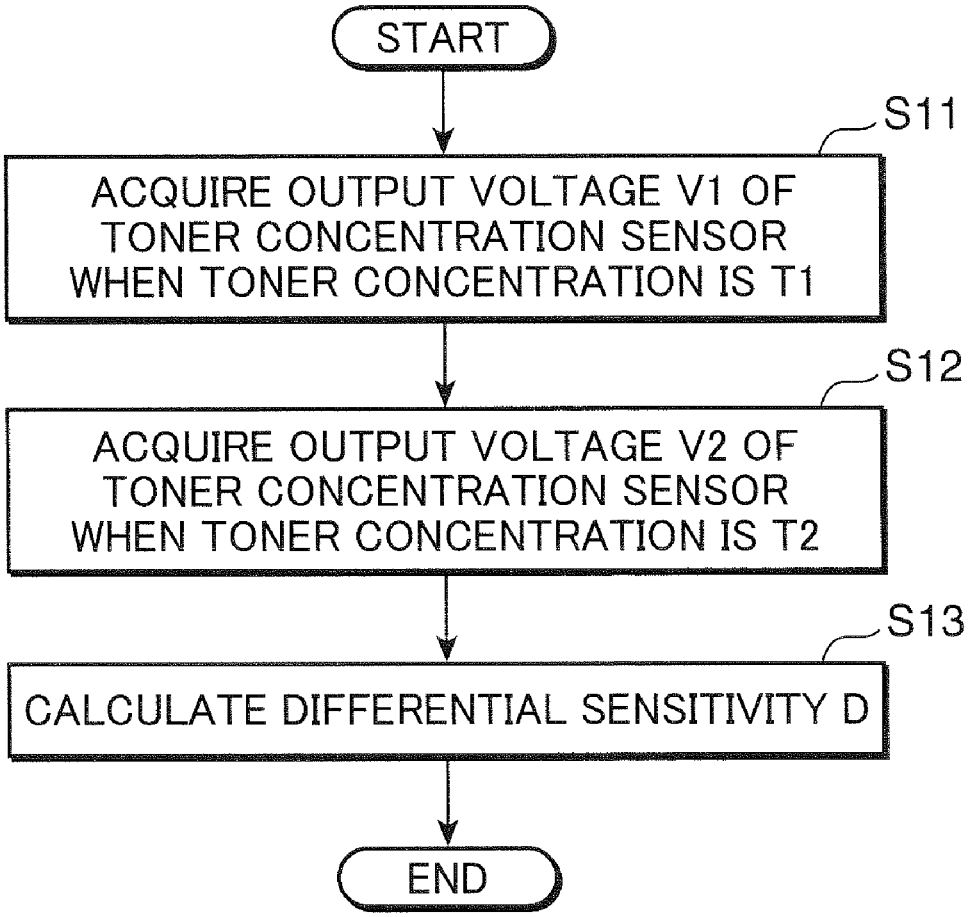
FIG. 4 is a flowchart showing the flow of a method to calculate the differential sensitivity D of a toner concentration sensor.

FIG. 4 is a flowchart showing the flow of a method to calculate the differential sensitivity D of a toner concentration sensor 128. First, in the initial operation time of the printer 1 (immediately after shipment from the factory), the toner receptacle 123*a*, in a state in which no toner whatsoever is supplied to the toner receptacle 123*a*, (that is, toner concentration 0%), the toner replenishment control portion 202 causes the toner replenishment motor 153 to supply the amount of toner necessary to make the toner concentration T1, and the differential sensitivity portion 201 acquires the output voltage V1 output from the toner concentration sensor 128 as the toner concentration T1 (step S11). Supply of the amount of toner necessary to make the toner concentration T1, and supply of the amount of toner necessary to make the toner concentration T2 as described below, are performed by for example having the toner replenishment control portion 202 control the number of rotations of the toner replenishment motor 153, based on information, stored in advance, on the number of rotations of the toner replenishment motor 153 and the amount of toner supplied in association with the number of rotations of the toner replenishment motor 153.

Next, the toner replenishment control portion 202 causes the toner replenishment motor 153 to replenish the toner receptacle 123*a*, in the state of toner concentration T1, with toner in the amount necessary to cause the toner concentration to be T2, and when the toner concentration is at T2, the differential sensitivity calculation portion 201 acquires the output voltage V2 output from the toner concentration sensor 128 (step S12), and the differential sensitivity calculation portion 201 substitutes each of the values into equation (1) and calculates the differential sensitivity D for the toner concentration sensor 128 (step S13). This calculation of the differential sensitivity D is for example performed only at the time of the initial operation of the printer 1; the toner concentration in the toner receptacle 123*a*, during operation is calculated by the toner replenishment control portion 202 using the differential sensitivity D.

As explained above, the differential sensitivity calculation portion 201 calculates the differential sensitivity D of the toner concentration sensor 128 in advance, and when detecting the toner concentration of the toner receptacle 123*a*, the toner replenishment control portion 202 uses equation (2) employing the differential sensitivity D or another equation to calculate the toner concentration, so that the calculated toner concentration is corrected for variation in the characteristics of the toner concentration sensor 128. That is, the accurate toner concentration is detected, unaffected by variation in the characteristics of the toner concentration sensor 128, and so the toner concentration of the toner receptacle 123*a*, can always be maintained at the appropriate value.

This invention is not limited to the configuration of the above embodiment, and appropriate modifications are possible. For example, in the above explanation the differential sensitivity of the toner concentration sensor 128 is calculated at the time of initial operation of the printer 1, and is stored in memory within the control portion 200 or similar; but prior to shipment from the factory, a worker may use the toner concentration sensor 128 to measure the output voltages V1 and V2 of the toner concentration sensor 128 when the toner receptacle 123*a*, is in the states of toner concentration T1 and T2, and may cause the measurement results to be stored in the toner concentration storage portion 211, and thereafter, at the time of initial operation of the printer 1, the differential sensitivity calculation portion 201 may read data from the toner concentration storage portion 211 and calculate the differential sensitivity D. By this means, the time necessary to acquire output voltages of the toner concentration sensor 128 with the toner receptacle 123*a*, in the states of toner concentration T1 and T2 at the time of initial operation is eliminated, and the differential sensitivity D can immediately be calculated.

This invention relates to a developer device, comprising: a developer portion which, while agitating, supplies a two-component developer of toner and carrier in a holding chamber to a photosensitive drum to develop an electrostatic latent image formed on the photosensitive drum, and form a toner image; a cartridge which houses toner; a measurement portion which measures the toner concentration in the holding chamber, converts a measurement result into a voltage value and outputs the voltage value; a replenishment portion which replenishes the holding chamber with toner from the cartridge; a calculation portion which uses a first voltage value measured by the measurement portion when the toner concentration of the holding chamber is a predetermined first toner concentration, and a second voltage value measured by the measurement portion when the toner concentration of the holding chamber is a predetermined second toner concentration, to calculate a differential sensitivity of the measurement portion; and a replenishment control portion which calculates the toner concentration in the holding chamber using the voltage value output from the measurement portion and the calculated differential sensitivity, and which controls replenishment of the holding chamber with toner by the replenishment portion according to the calculated toner concentration.

Further, this invention relates to an image forming apparatus, comprising: a developer portion which, while agitating, supplies a two-component developer of toner and carrier in a holding chamber to a photosensitive drum to develop an electrostatic latent image formed on the photosensitive drum, and form a toner image; a cartridge which houses toner; a measurement portion which measures the toner concentration in the holding chamber, converts a measurement result into a voltage value and outputs the voltage value; a replenishment portion which replenishes the holding chamber with toner from the cartridge; a calculation portion which uses a first voltage value measured by the measurement portion when the toner concentration of the holding chamber is a predetermined first toner concentration, and a second voltage value measured by the measurement portion when the toner concentration of the holding chamber is a predetermined second toner concentration, to calculate a differential sensitivity of the measurement portion; and a replenishment control portion which calculates the toner concentration in the holding chamber using the voltage value output from the measurement portion and the calculated differential sensitivity, and which controls replenishment of the holding chamber with toner by the replenishment portion according to the calculated toner concentration.

Further, this invention relates to a toner replenishment method for replenishing toner to a developer device which, while agitating, supplies a two-component developer of toner and carrier in a holding chamber to a photosensitive drum to develop an electrostatic latent image formed on the photosensitive drum, and form a toner image, having: a calculation step of calculating a differential sensitivity of a measurement portion which measures the toner concentration in the holding chamber, converts a measurement result to a voltage value and outputs the voltage value, using a first voltage value measured by the measurement portion when the toner concentration of the holding chamber is a predetermined first toner concentration and a second voltage value measured by the measurement portion when the toner concentration of the holding chamber is a predetermined second toner concentration; and a replenishment step of calculating a current toner concentration in the holding chamber using a current voltage value output from the measurement portion and the differential sensitivity calculated in the calculation step, and of replenishing the holding chamber with toner according to the toner concentration.

This invention also relates to a developer device in which, during operation of the developer device, the calculation portion acquires, as the first voltage value, the voltage value from the measurement portion when the toner concentration of the holding chamber is the first toner concentration, acquires, as the second voltage value, the voltage value from the measurement portion when the toner concentration of the holding chamber is the second toner concentration, and calculates the differential sensitivity of the measurement portion from the first voltage value and the second voltage value.

This invention also relates to a toner replenishment method in which the calculation step has: a first measurement step of acquiring, as the first voltage value, the measurement result of the measurement portion when the toner concentration of the holding chamber is the first toner concentration; a second measurement step of acquiring, as the second voltage value, the measurement result of the measurement portion when the toner concentration of the holding chamber is the second toner concentration; and a differential sensitivity calculation step of calculating the differential sensitivity of the measurement portion using the first voltage value and the second voltage value.

The "differential sensitivity" is the amount of change in the voltage value of the measurement portion with a change in the toner concentration in the holding chamber. It is known that there is variation of this differential sensitivity among individual measurement portions. Hence by calculating the differential sensitivity of the measurement portion in advance, and calculating the toner concentration using the calculated differential sensitivity when the current differential sensitivity of the holding chamber is detected, as in this invention, the toner concentration corrected according to the differential sensitivity of the measurement portion is calculated. That is, the accurate toner concentration, unaffected by variation in the measurement portion characteristics, is detected, so that the toner concentration in the holding chamber can be maintained at an appropriate value.

Further, there is no need to use a control voltage to correct the differential sensitivity of the measurement portion as in the prior art, that is, by measuring in advance the change in output voltage with the change in control voltage applied to the toner concentration sensor, and using the measurement result to correct the output voltage of the toner concentration sensor, so that an inexpensive configuration can be realized.

Further, there is no need to divide the output voltage of a toner concentration sensor into a plurality of levels and correct the output voltage using correction values for each level, as in the prior art, so that the toner concentration can be detected more accurately.

Further, this invention relates to a developer device which further comprises a storage portion which stores in advance the measurement result of the measurement portion when the toner concentration of the holding chamber is the predetermined first toner concentration as the first voltage value, and the measurement result of the measurement portion when the toner concentration of the holding chamber is the predetermined second toner concentration as the second voltage value, and in which the calculation portion calculates the differential sensitivity of the measurement portion using the stored first voltage value and second voltage value.

Further, this invention relates to a toner replenishment method in which the calculation step has: a storage step of storing in advance, prior to operation of the device, the measurement result of the measurement portion when the toner concentration of the holding chamber is the first toner concentration as the first voltage value, and the measurement result of the measurement portion when the toner concentration of the holding chamber is the second toner concentration as the second voltage value; and a differential sensitivity calculation step of calculating the differential sensitivity of the measurement portion using the first voltage value and the second voltage value stored in the storage step.

By means of this invention, first the differential sensitivity of the measurement portion is calculated in advance, and when the current toner concentration of the holding chamber is detected, the calculated differential sensitivity is used to calculate the toner concentration, so that the toner concentration corrected according to the differential sensitivity of the measurement portion can be ascertained. That is, the accurate toner concentration can be detected, without being affected by variation in the characteristics of the measurement portion, so that the toner concentration of the holding chamber can always be maintained at an appropriate value. Further, there is no need to use a control voltage to correct the differential sensitivity of the measurement portion, and an inexpensive configuration can be realized; moreover, there is no need to perform correction with the measurement portion output voltage divided into a plurality of levels, so that the toner concentration can be detected more accurately.

This application is based on Japanese Patent application serial No. 2008-299038, filed in Japan Patent Office on Nov. 25, 2008, respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developer device, comprising:

a developer portion which, while agitating, supplies a two-component developer of toner and carrier in a holding chamber to a photosensitive drum to develop an electrostatic latent image formed on the photosensitive drum, and form a toner image;

a cartridge which houses toner;

a measurement portion which measures the toner concentration in the holding chamber, converts a measurement result into a voltage value and outputs the voltage value;

a replenishment portion which replenishes the holding chamber with toner from the cartridge;

a replenishment control portion that controls a number of rotations of a toner replenishment motor of the replenishment portion to replenish the holding chamber with toner of a replenishment amount from the cartridge according to the number of rotations; and a calculation portion which calculates a differential sensitivity of the measurement portion obtained by dividing a voltage difference between a first voltage value measured by the measurement portion when a toner concentration of the holding chamber is set to a predetermined first toner concentration by the toner replenishment by the replenishment control portion, and a second voltage value measured by the measurement portion when the toner concentration of the holding chamber is set to a predetermined second toner concentration larger than the first toner concentration by the toner replenishment by the toner replenishment control portion, with a difference between the first toner concentration and the second toner concentration, wherein the replenishment control portion calculates, as a toner concentration at a toner concentration measurement time, a value obtained by subtracting, from the first toner concentration, a value obtained by dividing a difference between a voltage value to be outputted from the measurement portion at the toner concentration measurement time, and the first voltage value, with the calculated differential sensitivity, and which controls replenishment of the holding chamber with toner by the replenishment portion according to the calculated toner concentration.

2. The developer device according to claim 1, wherein, during operation of the developer device, the calculation portion acquires, as the first voltage value, the voltage value from the measurement portion when the toner concentration of the holding chamber is the first toner concentration, acquires, as the second voltage value, the voltage value from the measurement portion when the toner concentration of the holding chamber is the second toner concentration, and calculates the differential sensitivity of the measurement portion from the first voltage value and the second voltage value.

3. The developer device according to claim 1, further comprising a storage portion which stores in advance the measurement result of the measurement portion when the toner concentration of the holding chamber is the measurement portion when the toner concentration of the holding chamber is the predetermined first toner concentration as the first voltage value, and the measurement result of the measurement portion when the toner concentration of the holding chamber is the predetermined second toner concentration as the second voltage value, wherein the calculation portion calculates the differential sensitivity of the measurement portion using the stored first voltage value and second voltage value.

4. An image forming apparatus, comprising:

a developer portion which, while agitating, supplies a two-component developer of toner and carrier in a holding chamber to a photosensitive drum to develop an electrostatic latent image formed on the photosensitive drum, and form a toner image;

a cartridge which houses toner;

a measurement portion which measures the toner concentration in the holding chamber, converts a measurement result into a voltage value and outputs the voltage value;

a replenishment portion which replenishes the holding chamber with toner from the cartridge;

a replenishment control portion which controls a number of rotations of a toner replenishment motor of the replenishment portion to replenish the holding chamber with toner of a replenishment amount from the cartridge according to the number of rotations; and a calculation portion whichcalculates a differential sensitivity of the measurement portion obtained by dividing a voltage difference between a first voltage value measured by the measurement portion when a toner concentration of the holding chamber is set to a predetermined first toner concentration by the toner replenishment by the replenishment control portion, and a second voltage value measured by the measurement portion when the toner concentration of the holding chamber is set to a predetermined second toner concentration larger than the first toner concentration by the toner replenishment by the replenishment control portion, with a difference between the first toner concentration and the second toner concentration, wherein the replenishment control portion calculates, as a toner concentration at a toner concentration measurement time, a value obtained by subtracting, from the first toner concentration, a value obtained by dividing a difference between a voltage value to be outputted from the measurement portion at the toner concentration measurement time, and the first voltage value, with the calculated differential sensitivity, and which controls replenishment of the holding chamber with toner by the replenishment portion according to the calculated toner concentration.

5. A toner replenishment method for replenishing toner to a developer device which, while agitating, supplies a two-component developer of toner and carrier in a holding chamber to a photosensitive drum to develop an electrostatic latent image formed on the photosensitive drum, and form a toner image, comprising:

a first replenishment step of replenishing the holding chamber with toner of a replenishment amount from a cartridge in accordance with a number of rotations of a toner replenishment motor of a replenishment portion by controlling the number of rotations of the toner replenishment motor;

a calculation step of calculating a differential sensitivity of a measurement portion obtained by dividing a voltage difference between a first voltage value measured by the measurement portion when a toner concentration of the holding chamber is set to a predetermined first toner concentration by the toner replenishment in the first replenishment step, and a second voltage value measured by the measurement portion when the toner concentration of the holding chamber is set to a predetermined second toner concentration larger than the first toner concentration by the toner replenishment in the first replenishment step, with a difference between the first toner concentration and the second toner concentration, the measurement portion being adapted to measure a toner concentration, convert a measurement result into a voltage value and output the voltage value; and a second replenishment step of calculating as a toner concentration at a toner concentration measurement time, a value obtained by subtracting from the first toner concentration, a value obtained by dividing a difference between a voltage value to be outputted from the measurement portion at the toner concentration measurement time, and the first voltage value, with the calculated differential sensitivity and replenishing the holding chamber with toner according to the toner concentration.

6. The toner replenishment method according to claim 5, wherein the calculation step has the steps of:

a storage step of storing in advance, prior to operation of the device, the measurement result of the measurement portion when the toner concentration of the holding chamber is the first toner concentration as the first voltage value, and the measurement result of the measurement portion when the toner concentration of the holding chamber is the second toner concentration as the second voltage value; and a differential sensitivity calculation step of calculating the differential sensitivity of the measurement portion using the first voltage value and the second voltage value stored in the storage step.

* * * * *